US006349696B1

(12) United States Patent
Shang et al.

(10) Patent No.: US 6,349,696 B1
(45) Date of Patent: Feb. 26, 2002

(54) ROTARY PISTON INTERNAL COMBUSTION ENGINE

(76) Inventors: Ke Jian Shang; Hua Miao, both of Hartlgasse 17/21, A-1020 Wien (AT)

( * ) Notice: Subject to any disclaimer, the term of this patent is extended or adjusted under 35 U.S.C. 154(b) by 0 days.

(21) Appl. No.: 09/180,162

(22) PCT Filed: Apr. 30, 1997

(86) PCT No.: PCT/AT97/00085

§ 371 Date: Nov. 3, 1998

§ 102(e) Date: Nov. 3, 1998

(87) PCT Pub. No.: WO97/42398

PCT Pub. Date: Nov. 13, 1997

(30) Foreign Application Priority Data

May 6, 1996 (AT) ..... 805/96

(51) Int. Cl.[7] ..... F02B 53/00
(52) U.S. Cl. ..... 123/237; 418/15; 418/139
(58) Field of Search ..... 123/203, 235, 123/236, 237, 238, 248; 418/15, 139

(56) References Cited

U.S. PATENT DOCUMENTS

| | | | | |
|---|---|---|---|---|
| 2,091,120 A | | 8/1937 | Kinney | |
| 2,248,639 A | | 7/1941 | Miksits | |
| 5,596,963 A | * | 1/1997 | Lai | 123/236 |
| 5,709,188 A | * | 1/1998 | Al-Qutub | 123/236 |

FOREIGN PATENT DOCUMENTS

| | | |
|---|---|---|
| DE | 387 287 | 12/1923 |
| DE | 404 080 | 10/1924 |
| DE | 817 058 | 7/1949 |
| DE | 822 312 | 7/1949 |
| DE | 1 476 672 | 12/1965 |
| DE | 1 931 522 | 1/1970 |
| DE | 4 305 669 | 8/1994 |
| FR | 510 945 | 12/1920 |
| FR | 2 083 703 | 12/1971 |
| GB | 1 469 295 | 4/1977 |
| WO | WO 95/35431 | 12/1995 |

* cited by examiner

*Primary Examiner*—Michael Koczo
(74) *Attorney, Agent, or Firm*—Thomas T. Moga, Esq.; Powell, Goldstein, Frazer & Murphy LLP

(57) ABSTRACT

A rotary piston internal combustion engine comprises a substantially circular-cylindrical compression space (3) and a substantially circular-cylindrical working space (4), rotary pistons (7, 8) which can rotate together about an axis of the compression space (3) and the working space (4), being disposed in the compression space (3) and the working space (4) are slides (19) which are arranged so as to be movable in the radial direction in order to abut sealingly the surface of the respective rotary piston (7, 8). The periphery of the working space has a first exhaust aperture (26). The working space has further exhaust apertures (27) which can be closed by exhaust valves (15) which can be closed and opened successively by means of an adjusting arrangement (17).

11 Claims, 15 Drawing Sheets

ROTARY PISTON INTERNAL COMBUSTION ENGINE

Figure 1:
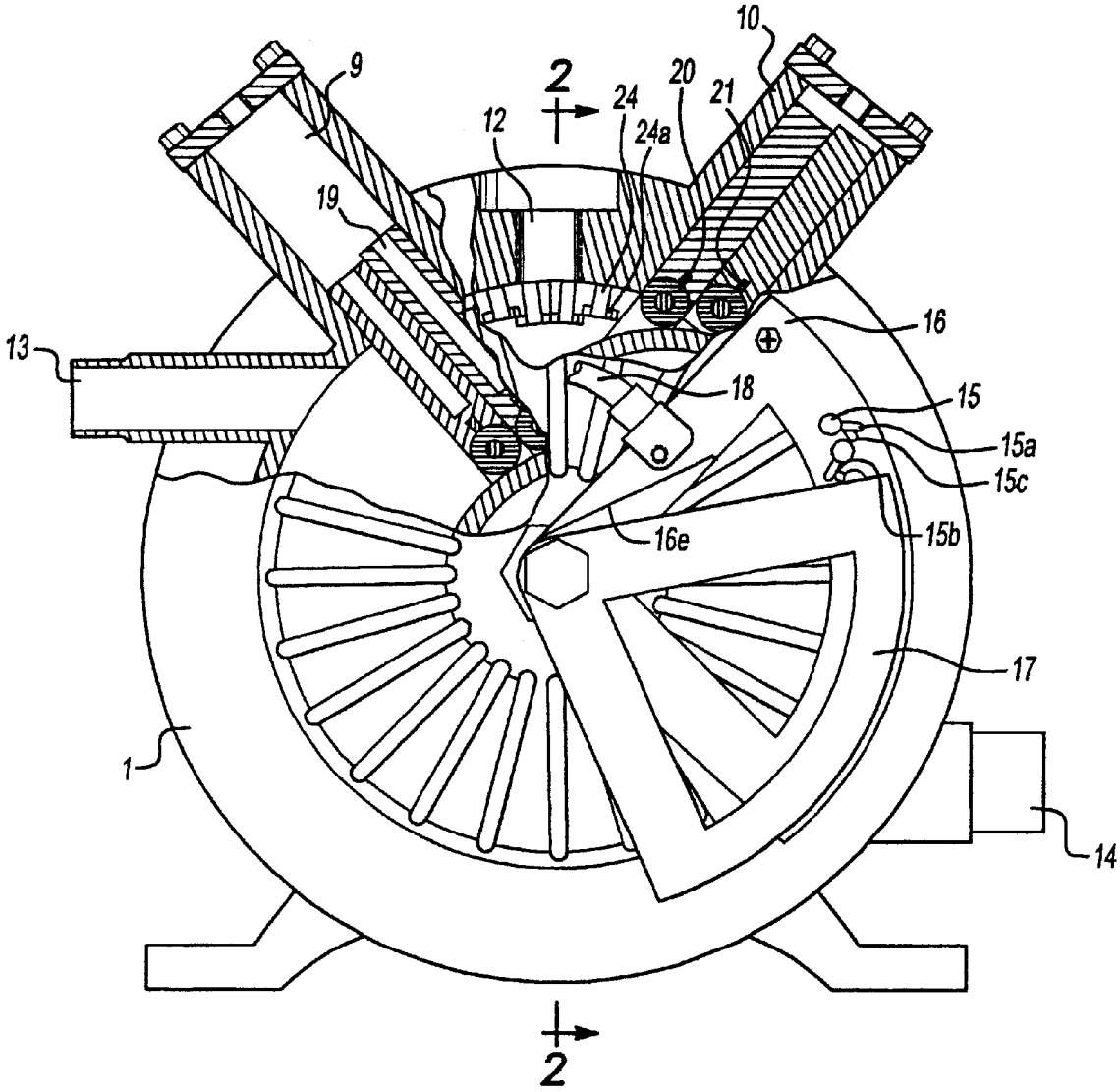

The present invention relates to a rotary piston internal combustion engine having a substantially circular cylindrical compression chamber and a substantially circular cylindrical working chamber, rotary pistons being arranged in the compression chamber and in the working chamber, jointly rotatable about an axis of the compression chamber and working chamber, slides being provided in the compression chamber and in the working chamber, arranged movable in radial direction to make sealing contact with the surface of the rotary piston in question, and a first exhaust aperture being provided on the periphery of the working chamber. Combustion engines on the rotary piston principle are especially advantageous, since they comprise no reciprocating pistons, so that smooth running and high speed are attainable.

The present invention pertains to a rotary piston combustion engine in which a partition is arranged separating the working chamber from the compression chamber, and oval rotary pistons being arranged in the compression chamber and working chamber, rotating, about an axis concentric with the compression chamber and working chamber. Compression and drive are achieved in that a slide movable substantially radially is in sealing contact with the surface of the rotary piston in question. The working chamber is larger than the compression chamber in proportion to the expansion ratio of the gaseous mixture.

Germany DE A 4,305,669 discloses such a rotary piston combustion engine. Here a smaller compression chamber and a larger working chamber are associated to accomplish the compression and combustion of the intake gas mixture and the expulsion of the exhaust gas. It is quite possible to operate such rotary piston combustion engines advantageously at certain speeds and under certain load conditions, and/or at certain air-fuel ratios, but a problem consists in that the volume of the working chamber is not variable according to the variation of speeds and load, or according to the variation of the air-fuel ratio. Two disadvantageous effects in particular thus occur:

At high speed or high load, at which a fat air-fuel ratio is applied, the expansion pressure of the burned gas cannot be completely utilized by the time the outlet slits open, so that energy is lost unused in the exhaust. The result is a relatively high fuel consumption and relatively high exhaust noise of such engines in that operating mode.

Secondly, it would be desirable in the low-speed or partial load range to achieve an earlier opening of the outlet slits to accelerate gas exchange and minimize losses.

Similar engines are disclosed in U.S. Pat. No. 2,091,120, Germany C 817,058, Germany C 822,312 and Germany A 1,931,522. In such engines also, inlet and outlet apertures are affected only by the rotary piston, whence again the disadvantages described above will arise.

Two further disadvantages of the known devices are that the rotation of the connecting disk comprise[s] a higher friction, as is shown in DE A 4,305,669, U.S. Pat. No. 2,091,120, DE C 817,058 and DE C 822,312, and that there is a sealing problem between slide, roller and rotary piston, especially in the case of a solution as provided in DE A 1,931,522.

Other motors of similar type are disclosed for example in DE C 387,287, DE C 404,080, DE A 1,476,672, France A 2,083,703 or Great Britain A 1,469,295.

The object of the present invention is to further develop the combustion engine initially described so as to make possible a new control for the volume of the working chamber, an improved connection control between compression chamber and working chamber, and an improved seal between slide, roller and rotary piston, to achieve optimal operation under various operating conditions.

According to the invention, this object is accomplished in that additional exhaust apertures are provided in the working chamber, closable by means of exhaust valves, which exhaust valves may be closed and opened successively by way of an adjusting means.

It is of the essence of the invention that the volume of the working chamber is associated with additional exhaust apertures and the exhaust valves. Thus according to the setting of the exhaust valves, the effective volume of the working space can be enlarged or reduced by closing or opening the additional exhaust apertures.

It is especially advantageous if the exhaust valves are in the form of rotary slides whose axes are substantially parallel to the axis of working chamber and compression chamber. In this way, actuation of the exhaust valves is possible in an especially simple manner. In particular, it is favorable if the adjusting means in turn is in the form of a rotary slide, preferably in connection with the exhaust valves by way of engaging levers. In this way, a dependable actuation of the exhaust valves is achieved. In a preferred modified embodiment of the present invention, provision is made to provide an exhaust manifold on the outer periphery of the working chamber, connecting the first exhaust aperture with the additional exhaust apertures.

It is especially advantageous if the connecting control valves are in the form of rotary slides arranged in the communicating apertures on the partition between the compression chamber and the working chamber, their axes substantially radial to the axis of working chamber and compression chamber. In this way, an actuation of the communicating control valves is possible with especial ease. In particular, it is favorable if the engaging grooves, preferably in communication with the connection control valves by way of engagers, are provided on the rotary pistons. In this way, a dependable actuation of the connecting control valves is achieved, the connecting control valves being rotatable by the rotary pistons in two opposed directions, and thereby opened or closed.

To especial advantage, the two slides bear rollers at the peak, sealed by sliding parts and leaf springs. In this way, the seal between slide, roller and rotary piston can be improved. The slides are guided on either side by tracks arranged on the partition and the supporting disks, which is especially important, since during the working stroke, comparatively high forces of expansion of the burned gages act one-sidedly on the slides. Wear is minimized in this way.

In the following, the invention will be illustrated in more detail with reference to the embodiment represented in the figures by way of example.

Figure 2:
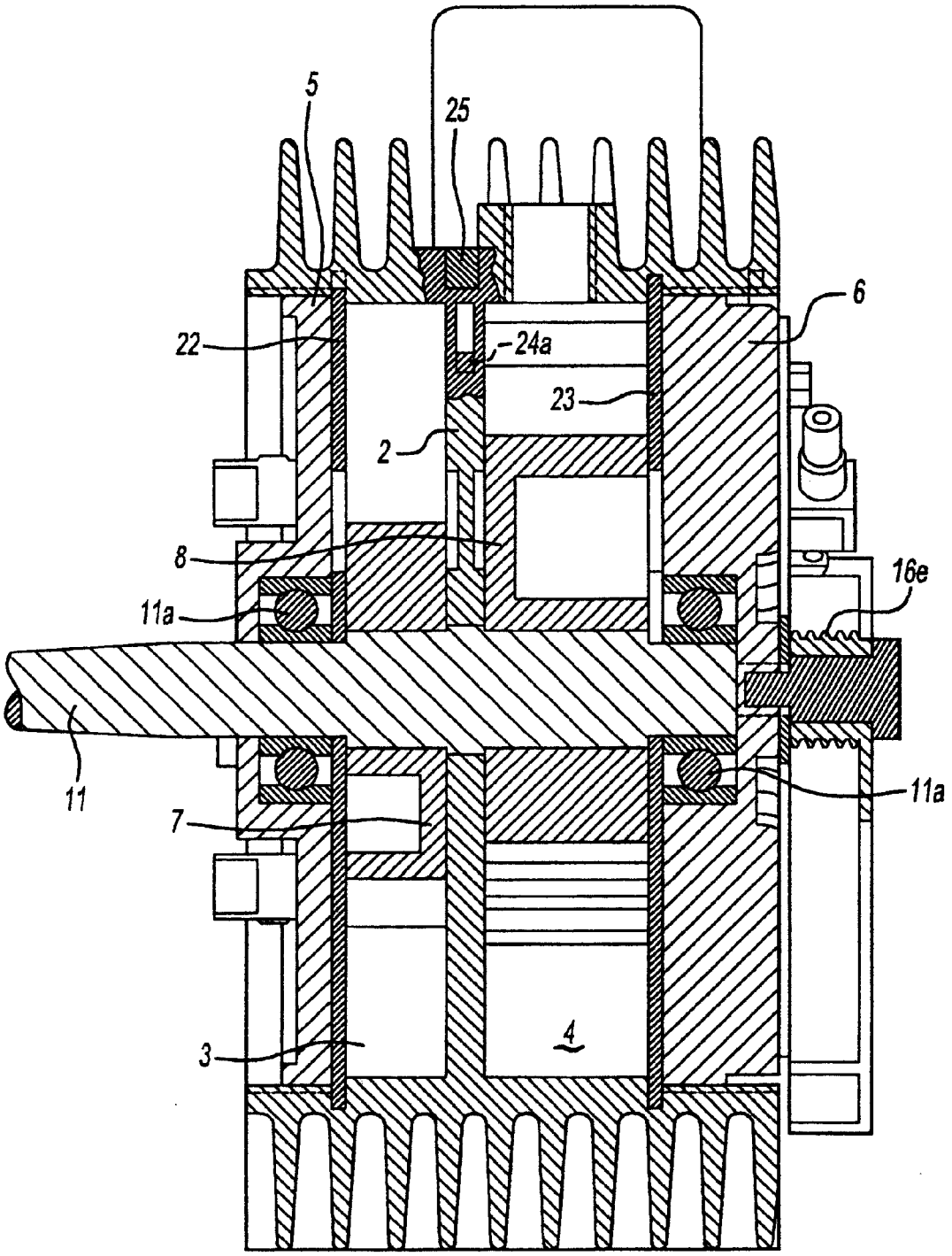
Figure 3:
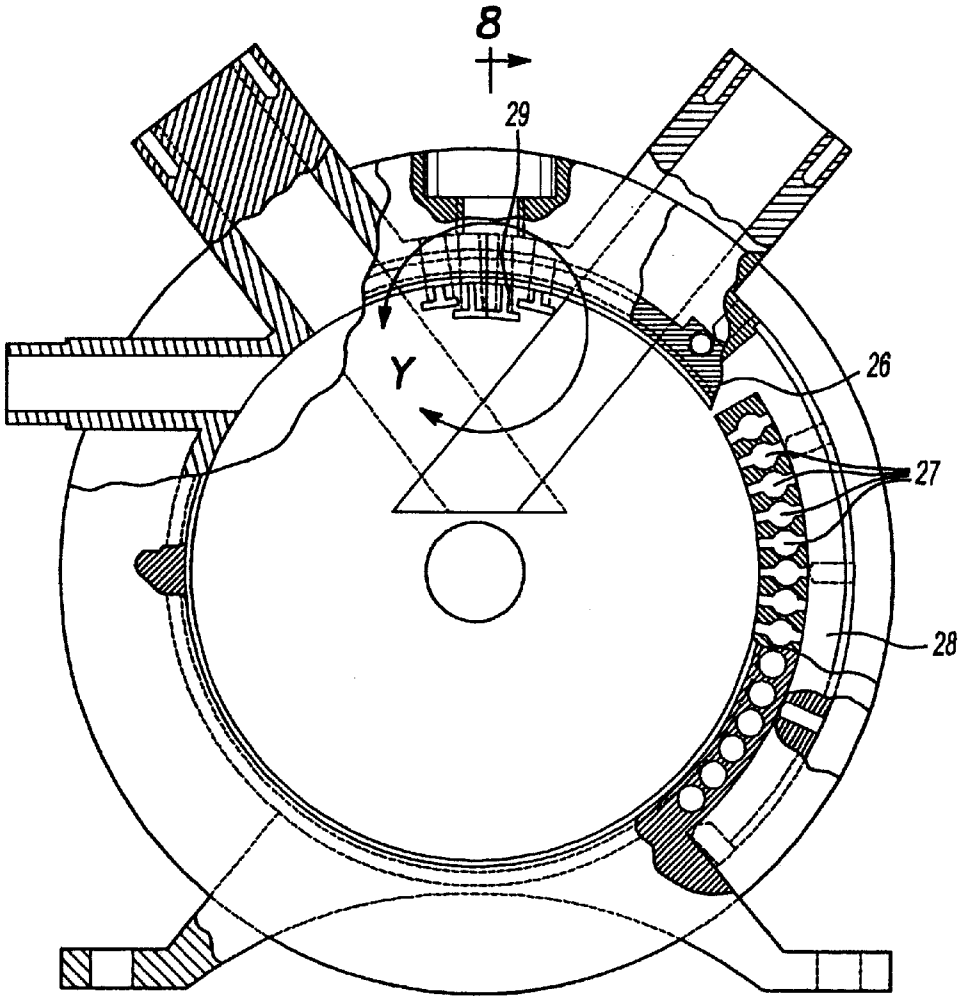
Figure 4:
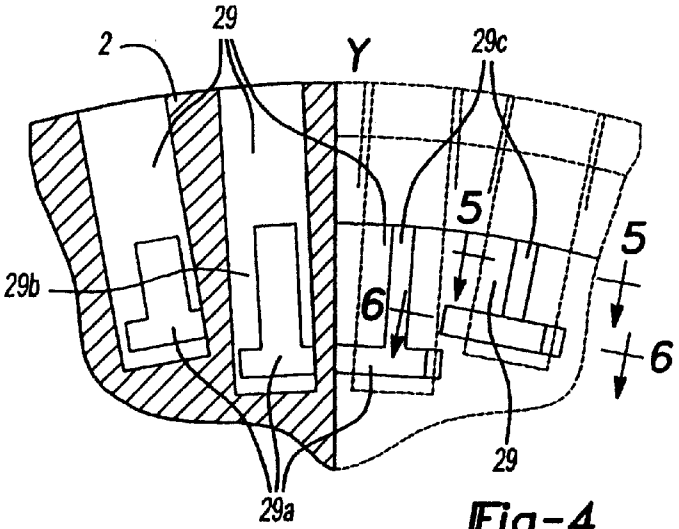
Figure 5:
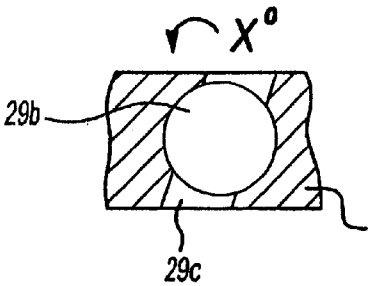
Figure 6:
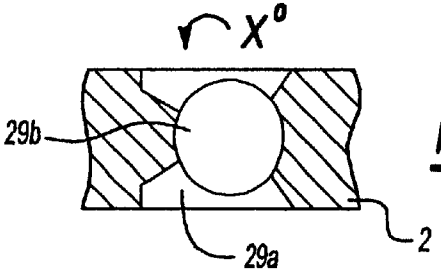
Figure 7:
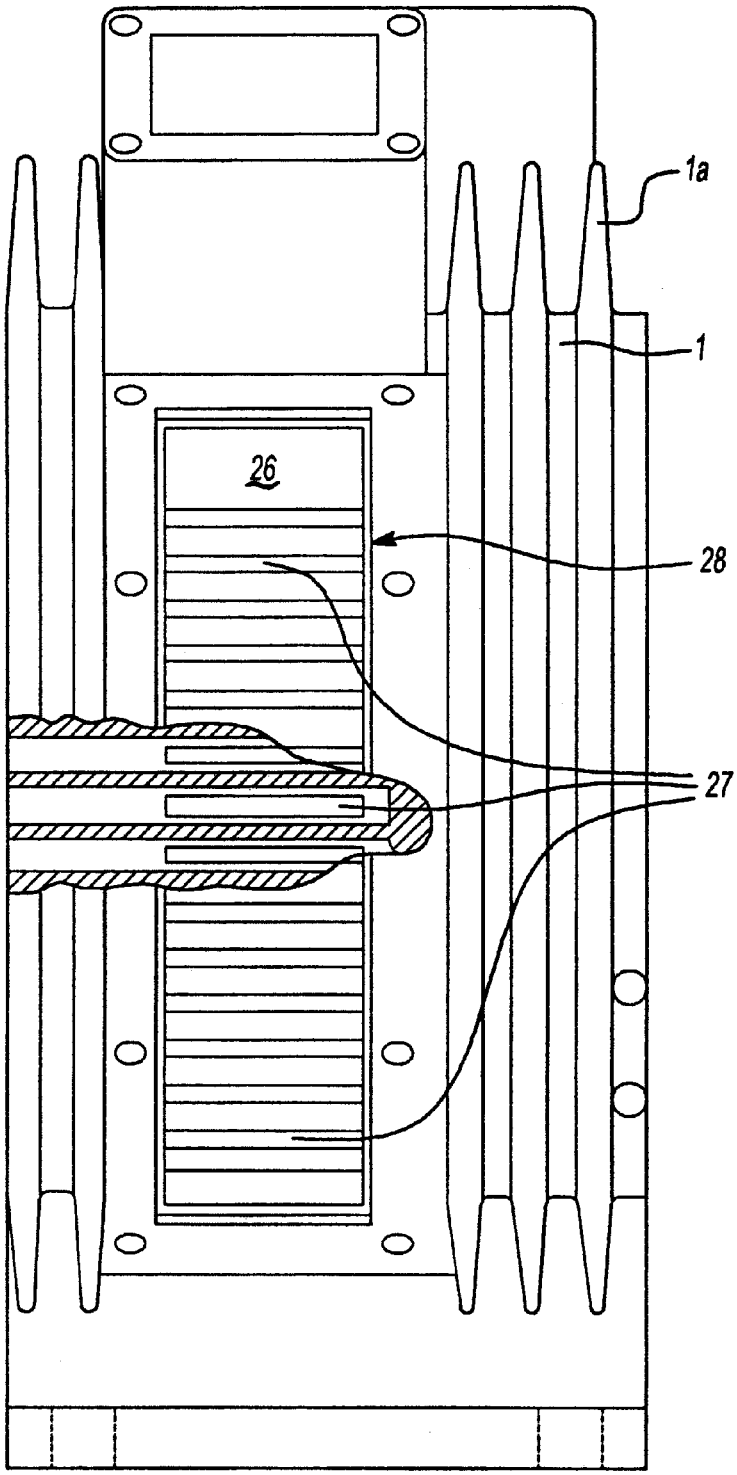
Figure 8:
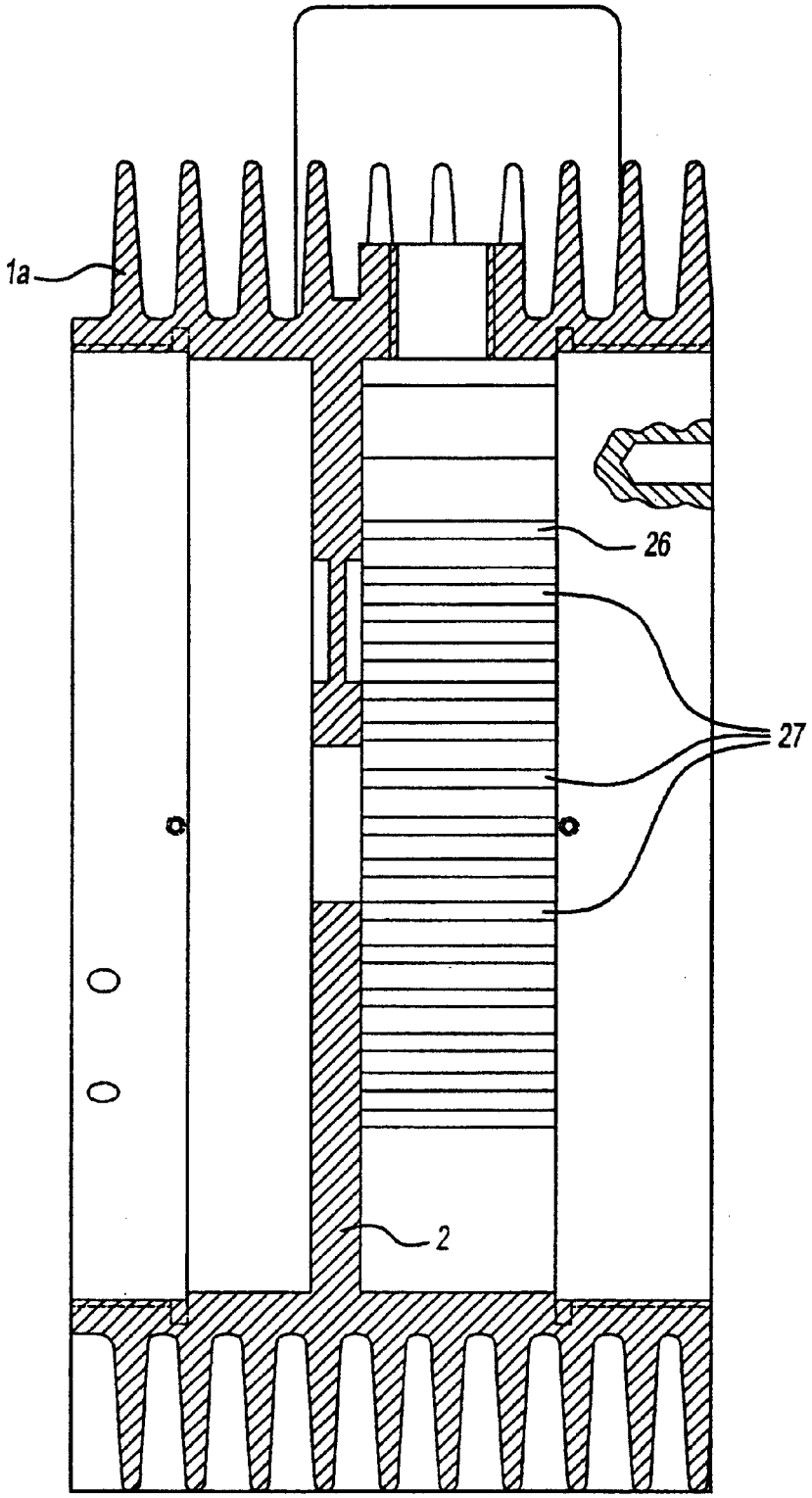
Figure 9:
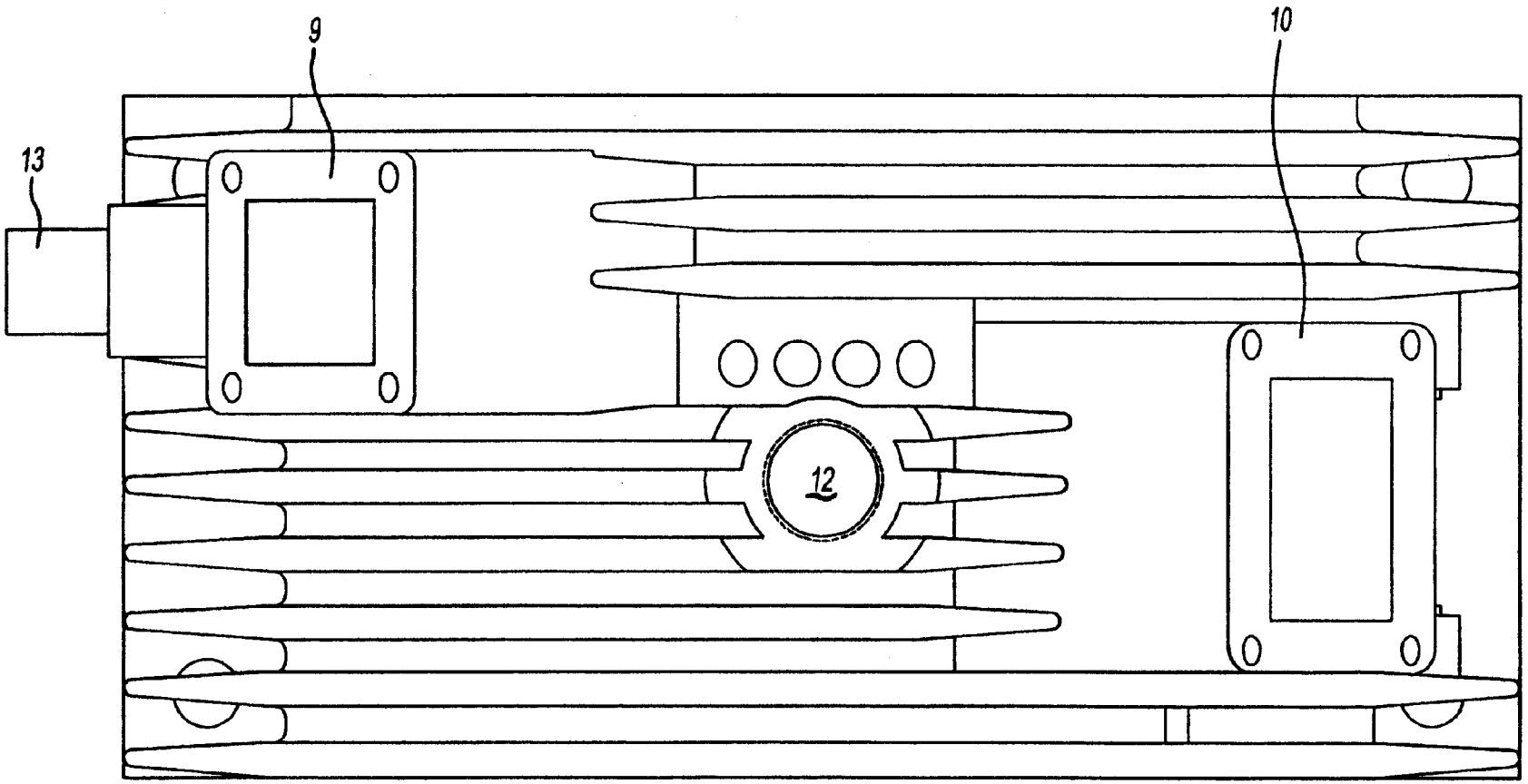
Figure 11:
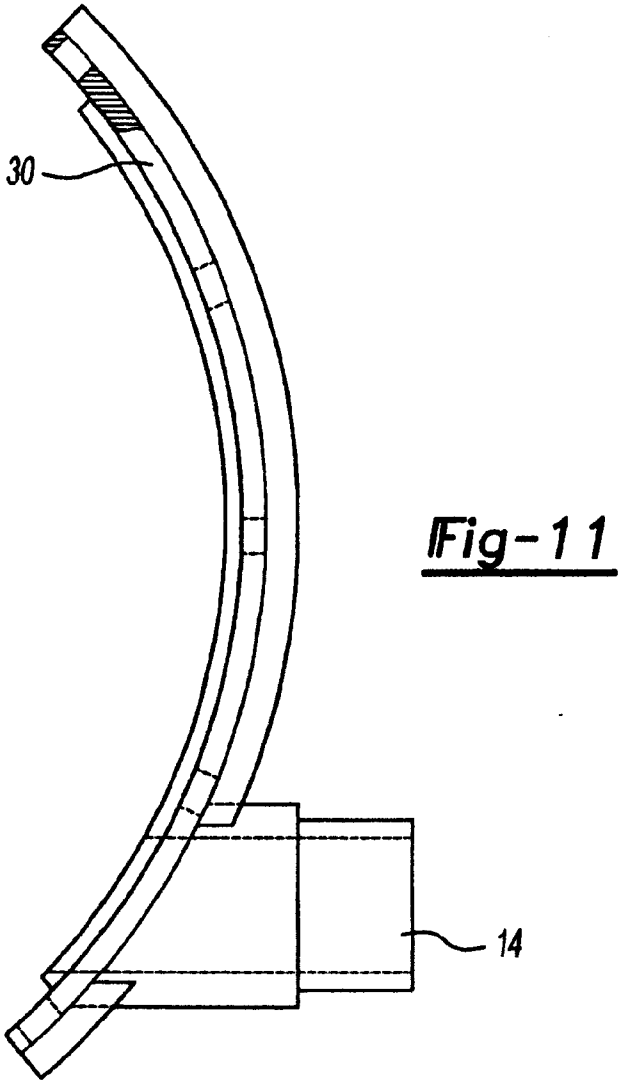
Figure 10:
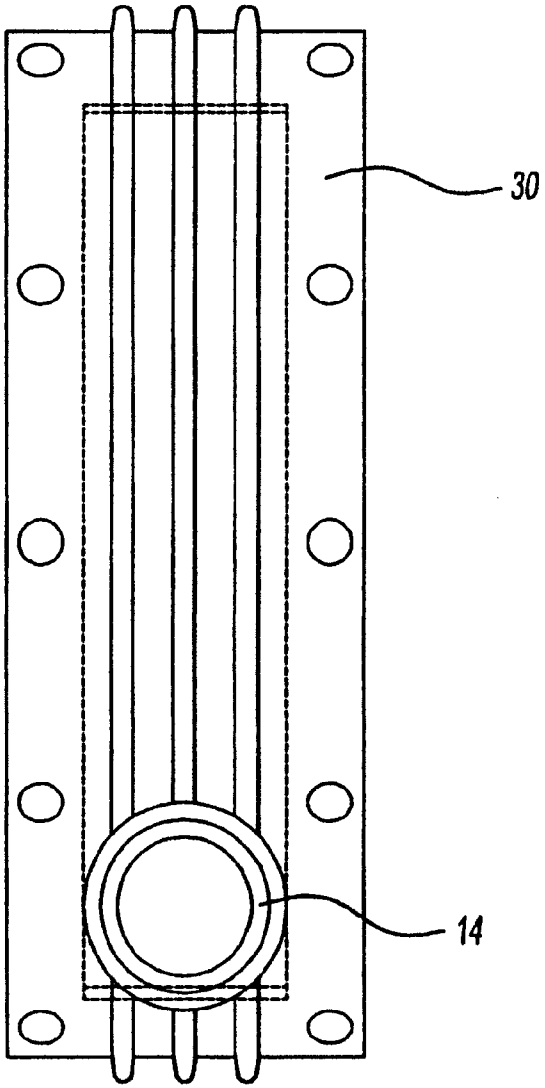
Figure 13:
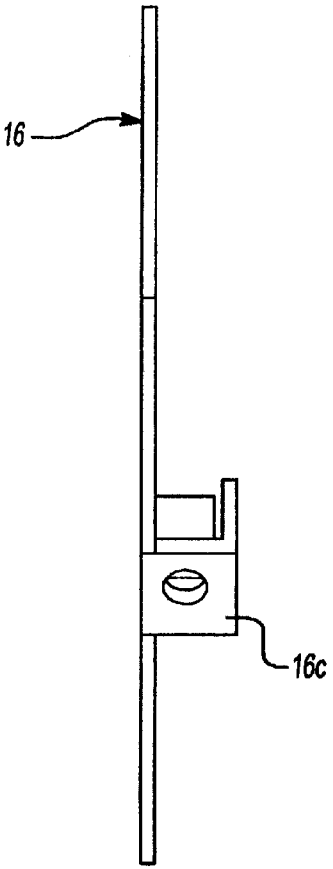
Figure 12:
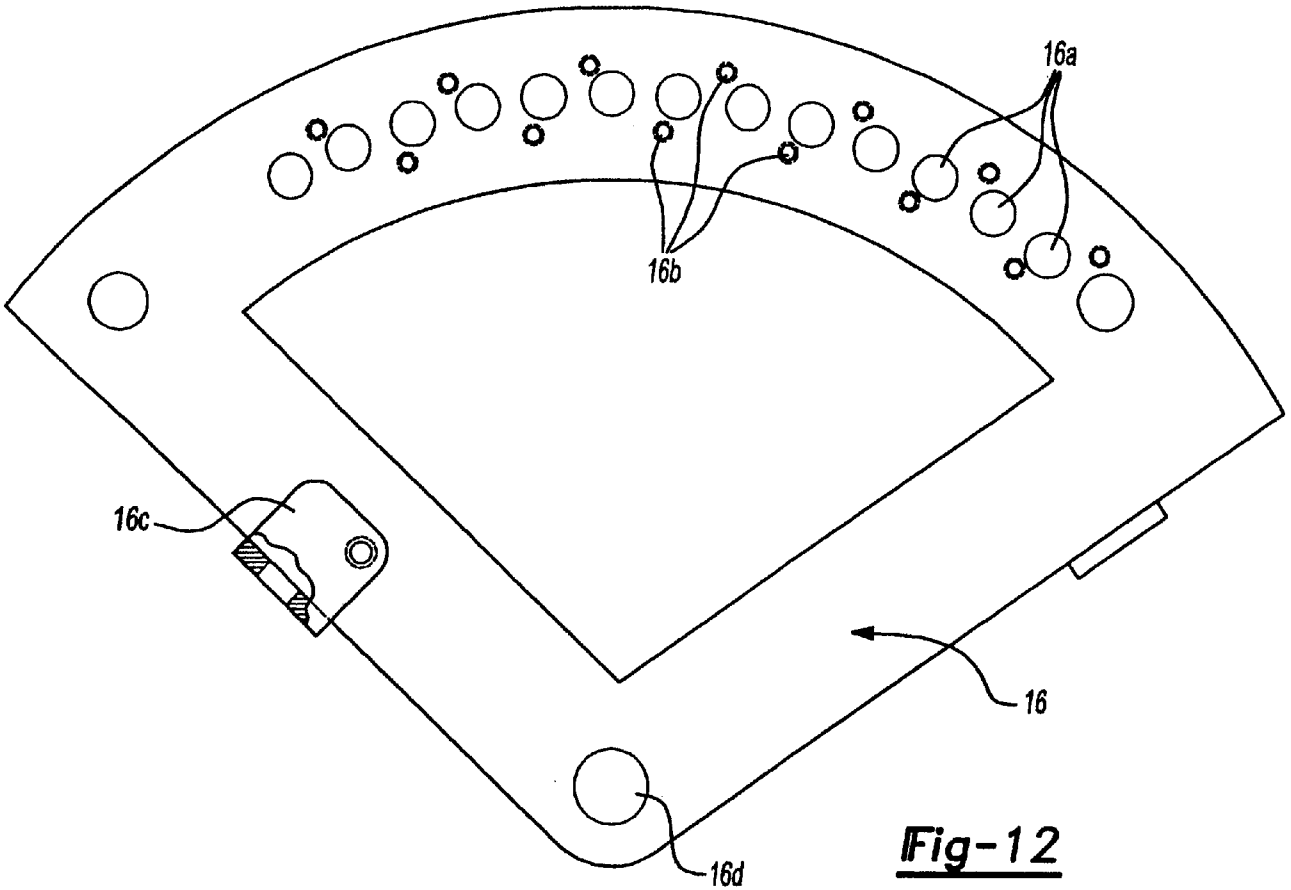
Figure 15:
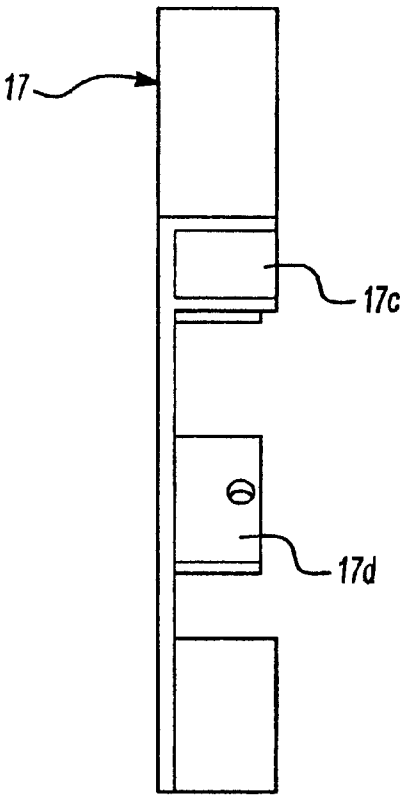
Figure 14:
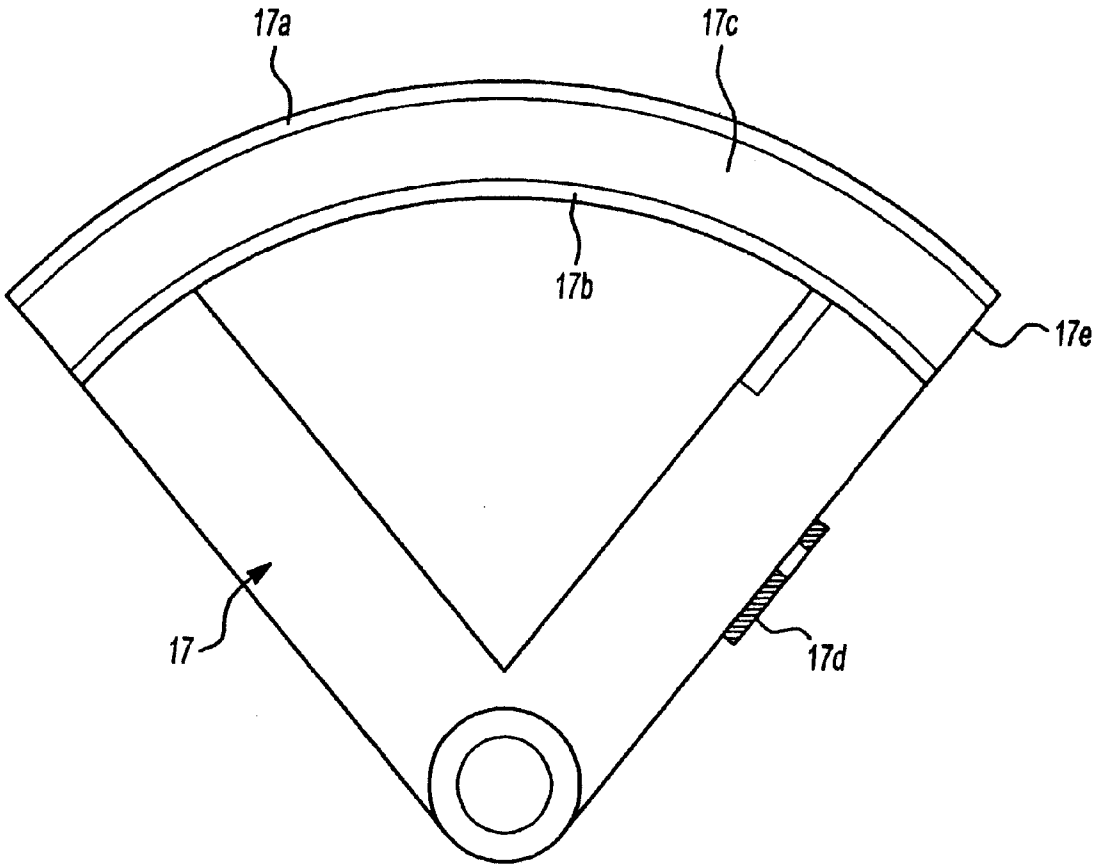
Figure 18:
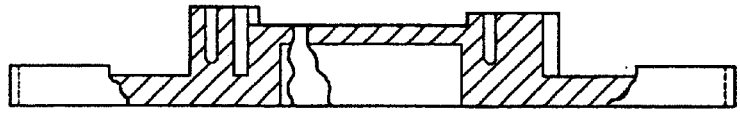
Figure 16:
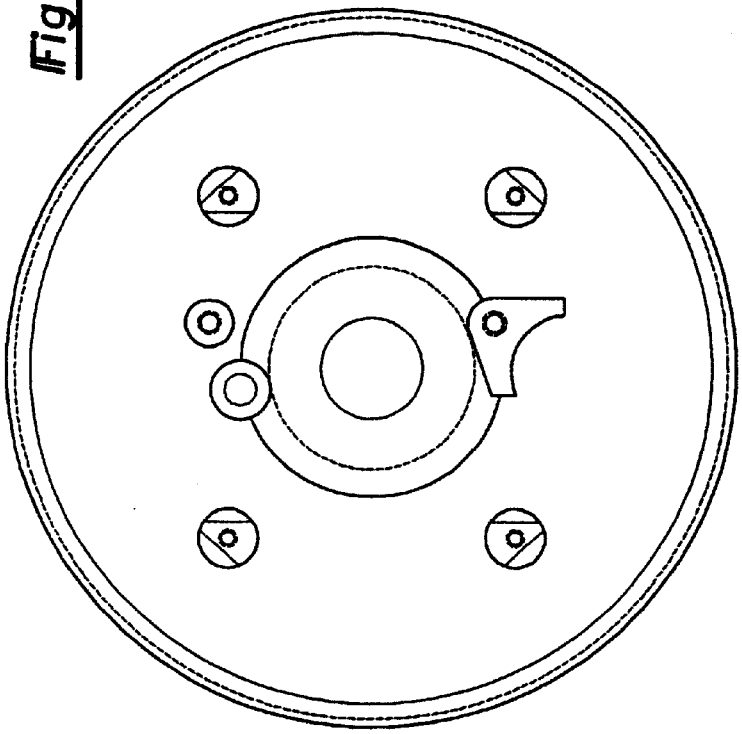
Figure 19:
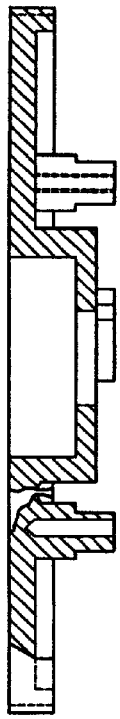
Figure 17:
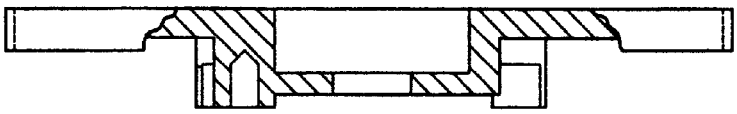
Figure 22:
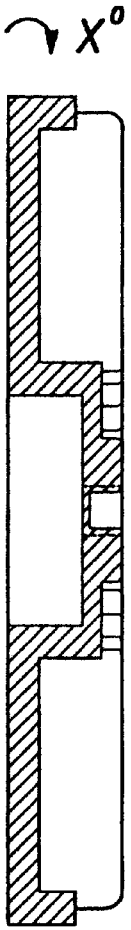
Figure 20:
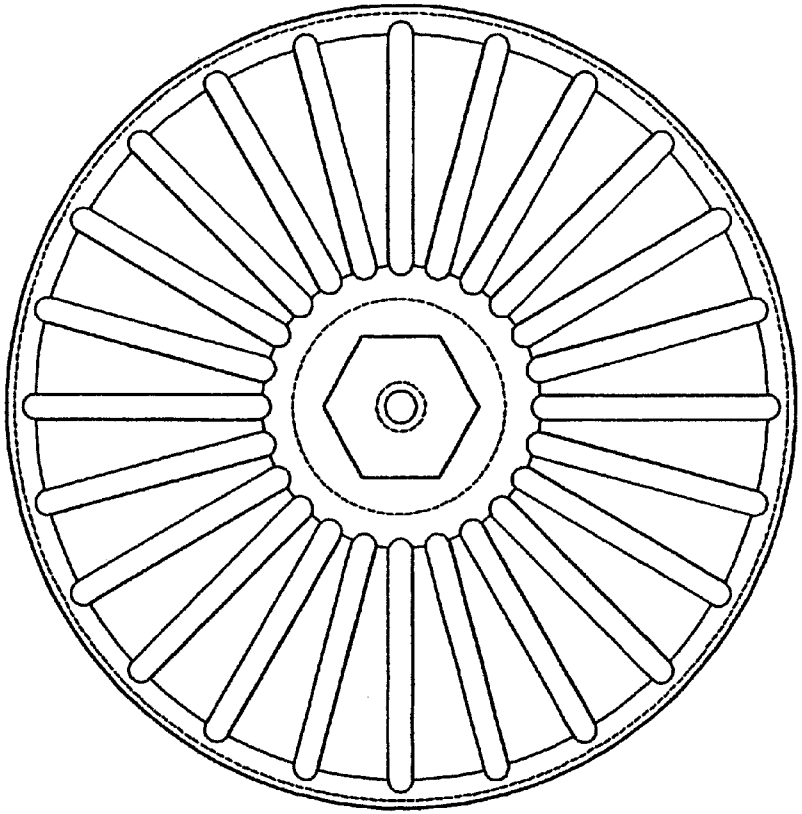
Figure 21:
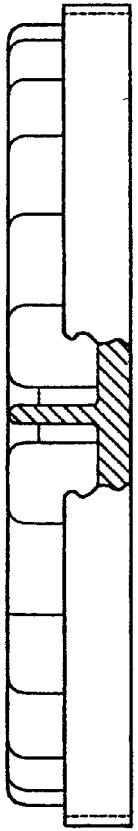
Figure 24:
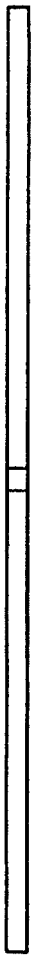
Figure 23:
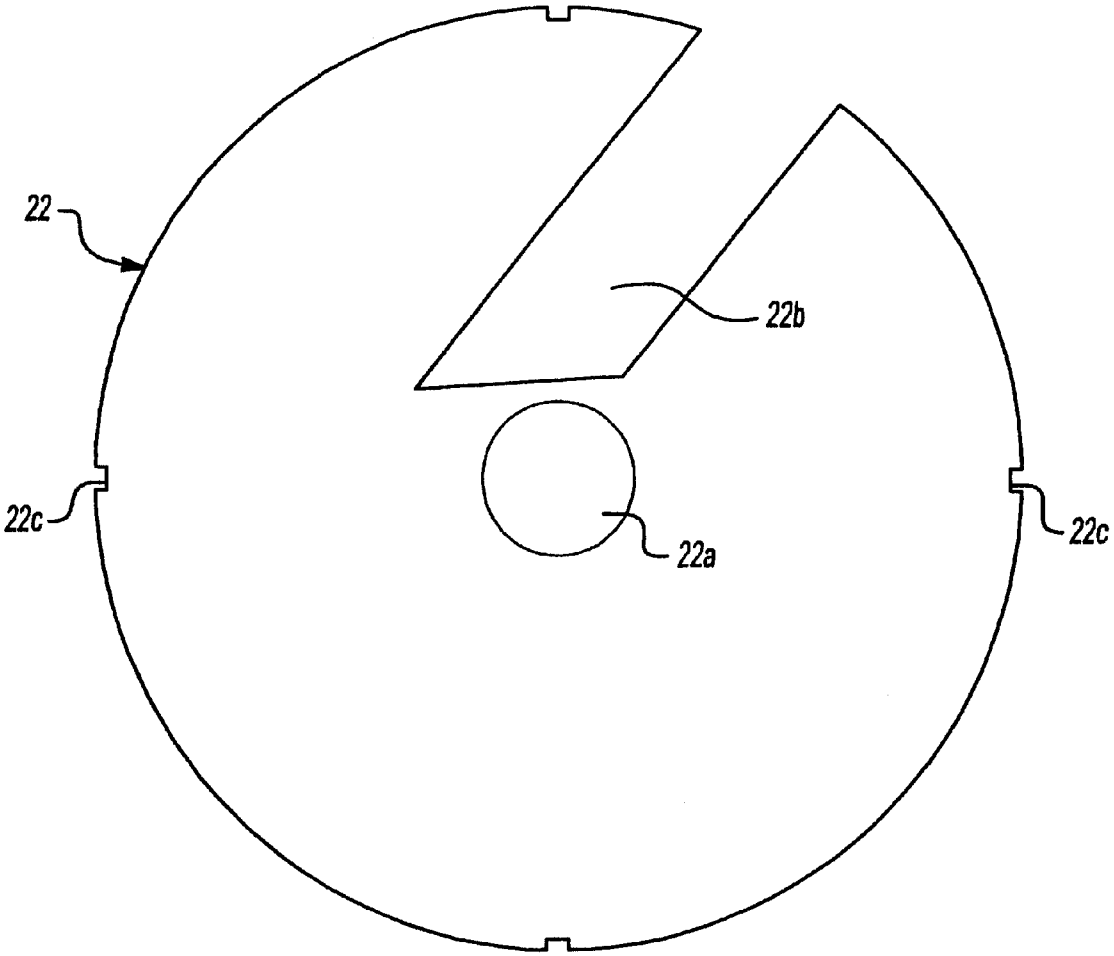
Figure 31:
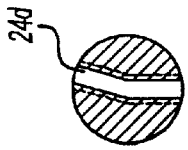
Figure 30:
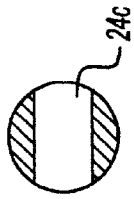
Figure 29:
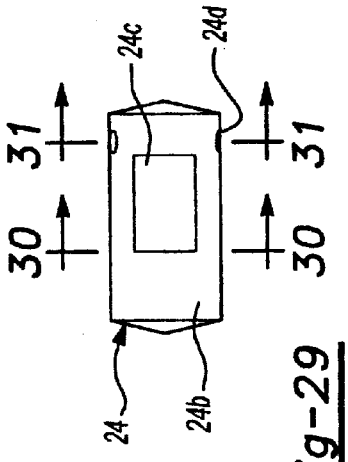
Figure 34:
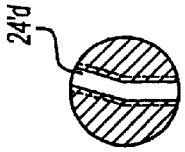
Figure 33:
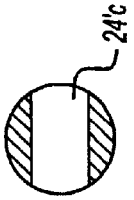
Figure 32:
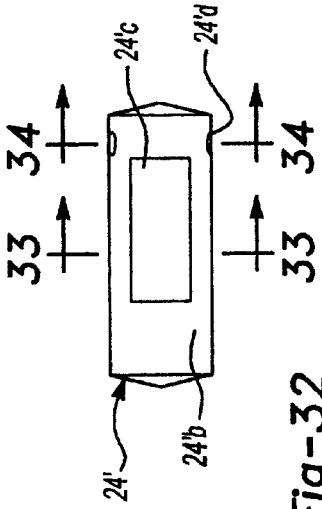
Figure 36:
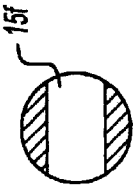
Figure 37:
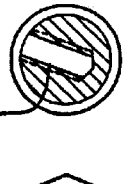
Figure 35:
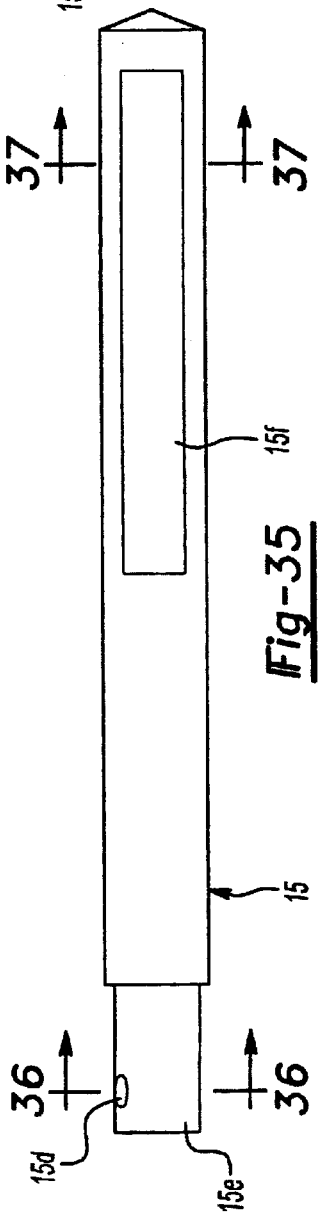

FIG. 1 shows a front view, in partial section, of the device according to the invention, FIG. 2 shows a section at the line 2—2 in FIG. 1, FIG. 3 shows a front view of the housing in partial section, FIG. 4 shows a front view of the communicating apertures at detail Y in FIG. 3 in partial section to a larger scale, FIG. 5 shows a section of the communicating aperture at the line 5—5 in FIG. 4, FIG. 6 shows a section of the communicating aperture at the line 6—6 in FIG. 4, FIG. 7 shows a right-hand side view of the housing in partial section, FIG. 8 shows a left-hand side view in partial section of the section of the housing at the line 8—8 in FIG. 3, FIG. 9 shows a top view of the housing, FIGS. 10 and 11 show views of the cover of the exhaust manifold, FIGS. 12 and 13 show views of the assembly plate to a larger scale, FIGS. 14 and 15 show views of the adjusting means, FIGS. 16 to 19 show configurations of the cover of the compression chamber, FIGS. 20 to 22 show configurations of the cover of the working chamber, FIGS. 23 and 24 show views of the support disk, FIGS. 25 to 28 show views of the rotary pistons, FIGS. 29 to 34 show representations of the connection control valves to a larger scale, FIG. 30 being a section at the line 30—30 in FIG. 29 and FIG.31 a section at the line 31—31 in FIG. 29, and FIG. 33 being a section at the line 33—33 in FIG. 32 and FIG. 34 a section at the line 34—34 in FIG. 32, FIGS. 35 to 37 show views of the exhaust valve to a larger scale, FIG. 36 being a section at the line 36—36 in FIG. 35 and FIG. 37 a section at the line 37—37 in FIG. 35.

The device according to the invention has a substantially cylindrical housing 1 divided by a partition 2 into two cylindrical chambers, namely a compression chamber 3 and a working chamber 4. At the ends, the housing 1 is closed off by a cover 6 on the side of the working chamber 4 and by a cover 5 on the side of the compression chamber 3. On the periphery of the housing 1, cooling fins la are provided. In the compression chamber. 3, a rotary piston 7 is rotatably arranged, whereas at the working chamber 4, a rotary piston 8 is rotatably arranged. The rotary pistons 7 and 8 are fixed against rotation on a common shaft 11. The shaft 11 is mounted on the covers 5 and 6 with low friction by way of rolling bearings 11*a*. An opening 12 serves to accommodate a spark plug, not shown. In the region of the compression chamber 3, a slide housing 9 is provided, projecting substantially radially outward. Similarly, a slide housing 10 is provided in the region of-the working chamber 4. A connection 13, communicating with the carburetor, not shown in detail, is provided on the outer periphery of the compression chamber.

In each of the slide housings 9, 10 two slides 19 are displaceably arranged, bearing rollers 20 at their anterior ends, to roll on the rotary pistons 7, 8. The wear parts with leaf springs 21 seal the rollers 20 from the slides 19. Support disks 22 and 23 represent the slide tracks of the slides 19 vis-a-vis the partition 2 and the covers 5 and 6 of the compression chamber 3 and working chamber 4 respectively.

In the communicating apertures 29, opened in the partition 2 between the compression chamber 3 and the working chamber 4, connection control valves 24 and 24' are provided, secured in their positions by a cover 25. Each communicating control valve 24, 24' is of essentially cylindrical structure and has two engagers 24*a* actuated by the rotary pistons 7 and 8. Thus communicating control valves are rotatable in two opposed directions, and, according to the setting of the rotary pistons 7, 8, establish or interrupt communication between compression chamber 3 and working chamber 4.

In FIGS. 29 to 34, the communicating control valves 24, 24' are shown in detail. In principle, the communicating control valves 24, 24' are alike in structure, differing only in length, since for reasons of space the communicating control valve 24 must be of shorter configuration. The communicating control valves 24, 24' each consist of a substantially cylindrical body 24*b*, 24*b'* having a through opening 24*c*, 24*c'* and an angled bore 24*d*, 24*d'* passing through the center of the cross-section. In this bore 24*d*, 24*d'*, two engagers 24*a* represented in FIGS. 1 and 2 are inserted.

The communicating apertures 29, as may be seen in FIGS. 5 and 6, are configured as bores with axis parallel to the partition 2, connecting slits 29*c* proceeding from either end of the bore 29*d* and opening towards both sides of the partition 2. In the lower segment, a recess 29*a* is provided to make room for motion of the pins 24*a*.

On the outer periphery of the working chamber 4, a constantly open first exhaust aperture 26 is provided, communicating by way of an output manifold passage 28 and a connection 14 on the cover 30 of the output manifold passage 28 with the exhaust, not shown in detail. Further, following the first exhaust aperture 26 in the direction of rotation, additional exhaust apertures 27 are provided extending over an angular range of about 90° of the periphery of the working chamber 4. These additional exhaust apertures 27 likewise connect the working chamber 4 with the exhaust manifold passage 28. In the additional exhaust apertures 27, exhaust valves 15 are arranged, having a substantially cylindrical structure and rotatable. Depending on the rotation of the exhaust valves 15, exhaust gas can or cannot pass through the exhaust apertures 27 from the working chamber 4 into the exhaust manifold passage 28. Each exhaust valve 15 has an engaging lever 15*a* prestressed in relation to a holding pin 15*c* by the action of an annular spring 15*b*. The engaging lever 15*a*, as may be seen in FIGS. 35 to 37, is inserted in a hole 15*d* arranged in an end segment 15*e*. A recess 15*f* is formed in the shape of a slit passing through radially, to allow the exhaust gases to pass. An assembly plate 16 guiding the exhaust valves 15 into the additional exhaust apertures 27 is arranged on the outside of the cover 6 of the working char 4. On the assembly plate 16, the holding pins 15*c* are fixed, and an adjusting means 17 is mounted, rotatable about the axis of the shaft 11 and configured in the form of a rotary slide. A Bowden cable 18, connected to control means not shown in detail, is also fixed on the assembly plate and adjusting means 17. The adjusting means 17 is actuated by the taut Bowden cable 18. An annular spring 16*e* prestresses the adjusting means 17 against the direction of tension of the Bowden cable 18. By rotation of the adjusting means 11 in the counterclockwise direction in FIG. 1 (purchase of Bowden cable 18), the additional exhaust apertures 27 are closed successively by rotation of the exhaust valves 15. In a contrary case, the exhaust valves 15 are opened successively. If all additional exhaust apertures 27 are closed, the effective volume of the working chamber is a maximum. If all additional apertures 27 are opened, the volume of the working space is a minimum.

FIG. 7 shows a side view of the housing 1, pointed at the opened exhaust manifold passage 28. The first exhaust aperture 26 and the additional exhaust apertures 27 may be seen.

FIG. 9 represents a view from above, to clarify the lines of section for the other figures.

FIGS. 10 and 11 show the cover 30 of the exhaust passage in detail, in which the connection 14 for the exhaust, not shown, is seen.

In FIGS. 12 and 13, the assembly plate 16 is shown individually. The assembly plate 16 has a hole 16*d* defining the center about which the adjusting means 17, not shown in these figures, is rotatable. At the same distance from this opening 16*d*, a row of first holes 16*a* is arranged, configured to guide the exhaust valves 15. Additional holes 16*b* serve to accommodate holding pins forming a stop for the engaging lever 15*a* of the exhaust valves 15. A suspension 16*c* serves to secure the Bowden cable 18.

The adjusting means 17, as may be seen in FIGS. 14 and 15, comprises a first web 17*a*, having the shape of a circular angular sector, and a second web 17*b* arranged concentric therewith. Between these webs 17*a* and 17*b*, a channel 17*c* is formed. The channel 17*c* is of such configuration that the projecting parts of the exhaust valves 15 are accommodated therein. A terminal portion of the channel 17*e*, 17*f*, or of the webs 17*a* and 17*b*, is configured to switch the engaging levers of the exhaust valves 15 when the end 17*e* slides over a corresponding exhaust valve 15. This causes the individual exhaust valves 15 to be switched one after another. A suspension 17*d* serves to secure the Bowden cable.

FIGS. 16 to 19 show various views of the cover 5 of the compression chamber 3, and FIGS. 20 to 22 show views of the cover 6 of the working chamber 4.

FIGS. 23 and 24 show the shape of the support disk 22. The support disk 23 is of like configuration. The support disk 22 has a bore 22*a* for the shaft 11. A slit 22*b* is provided to guide the slide 19. Grooves 22*c* arranged on the periphery serve for accurate positioning of the support disk 22 in the compression chamber 3.

Figure 25:
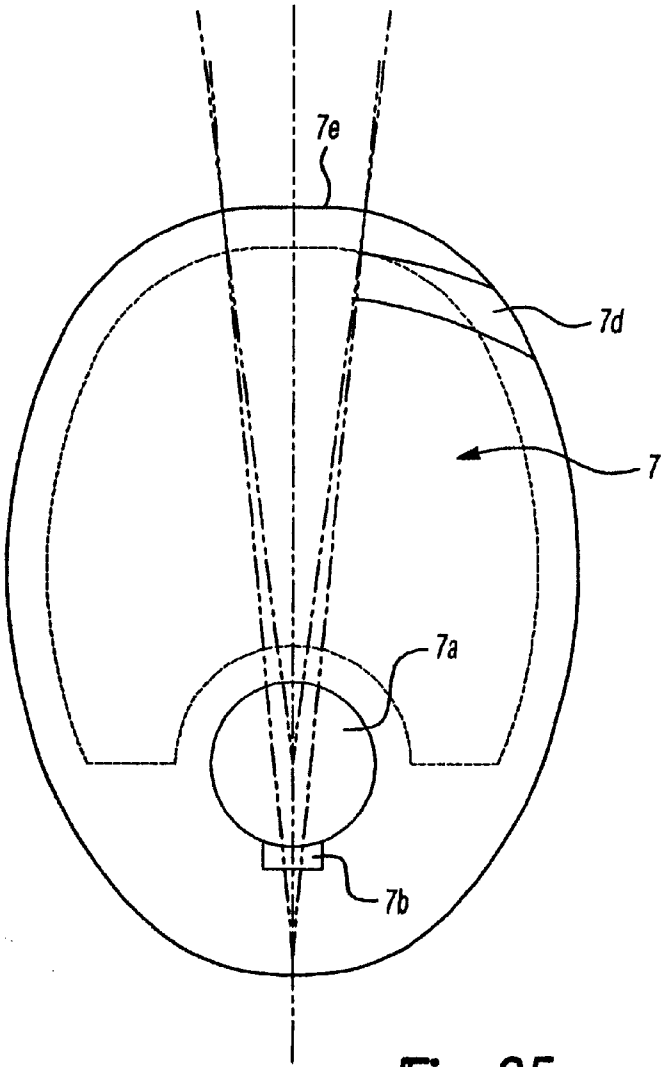
Figure 26:
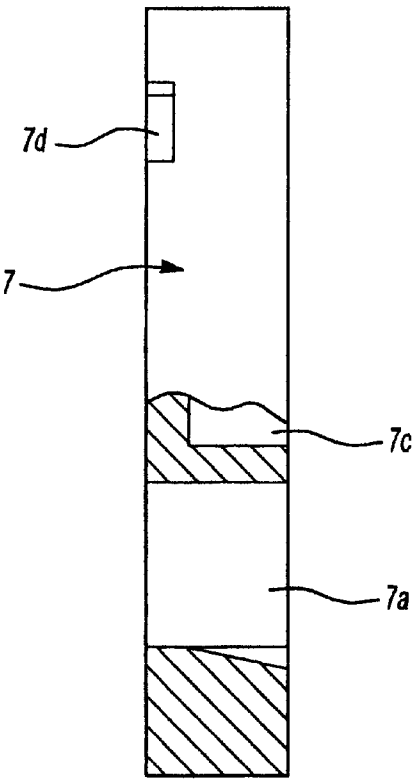
Figure 28:
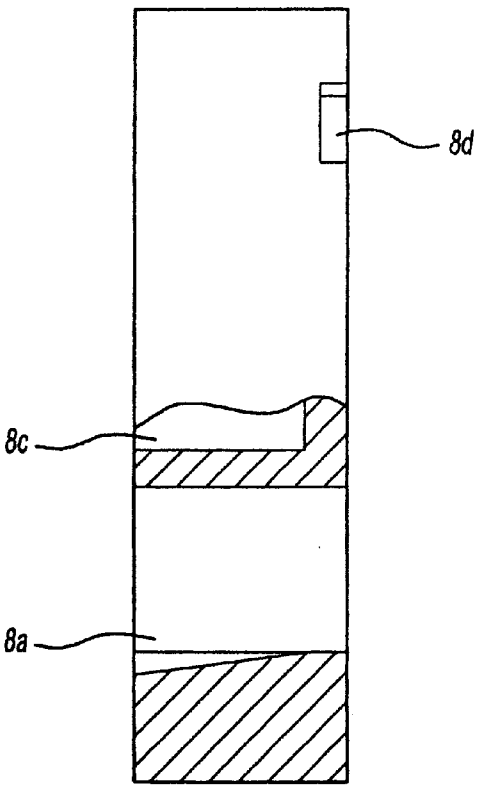
Figure 27:
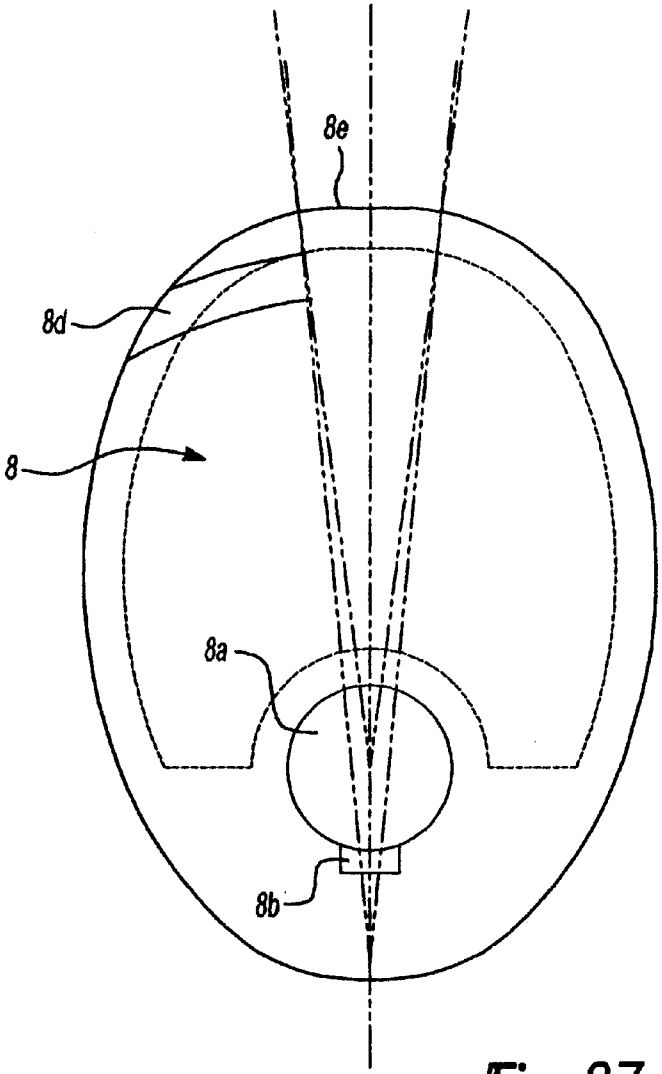

In FIGS. 25 and 26, the pump piston 7 is shown separately. The piston is of oval configuration and has a bore 7*a* with grooves 7*b* for the shaft 11, or a key spring, not shown in detail, representing a safety against rotation relative to the shaft 11. In a main part of the piston 7, a recess 7*c* and an engager groove 7*d*, communicating with the outer periphery of the piston 7 and in engagement with the engagers 24*a* of the connection control valves 24, 24 are provided. The piston 7 is substantially oval in configuration, and has a slide segment 7*e* in the portion farthest removed from the bore 7*a*. The slide segment 7*e* is in the form of a circular sector area whose center is on the centerline of the shaft. In this way, a good sealing effect can be achieved. The rotary piston 8 is similar in configuration to the rotary piston 7, but in mirror image thereto, and with dimensions adapted to the working chamber 4. The bore 8*a* with keyway 8*b*, recess 8*c*, engager groove 8*d* and sealing segment 8*e* correspond to the rotary piston 7 elements referenced 7*a*, 7*b*, 7*c*, 7*d* and 7*e* respectively.

The combustion engine according to the invention makes it possible for the volume of the working chamber to be varied by closing or opening of the additional exhaust apertures according to the variation of speeds and loads or according to the air-fuel ratio of the gaseous mixture, for the connection between compression chamber and working chamber to be easily controlled by the closing or opening of the communicating valves, and for the seal between slide, roller and rotary piston to be improved by the arrangements of the slides, wear parts and leaf springs. In this way a high output and a favorable exhaust behavior with low exhaust noise is achieved in numerous operating modes.

It will be obvious to those skilled in the art that the combustion engine of the present invention may be made with a plurality of compression chambers and/or working chambers, by arranging them offset in axial direction on a common shaft. It will be clear also that the combustion engine according to the invention, which has been described as an Otto engine in the embodiment represented by way of example, might operate equally on the Diesel principle. In that case, the appropriate changes concerning compression ratio would have to be made in a manner familiar to those skilled in the art. Instead of the spark plug, an injection nozzle would be required.

What is claimed is:

1. Rotary piston internal combustion engine having a substantially circular cylindrical compression chamber (3) and a substantially circular cylindrical working chamber (4), rotary pistons (7, 8) being arranged in the compression chamber (3) and in the working chamber (4), slides (19) being provided in the compression chamber (3) and in the working chamber (4), arranged movable in radial direction to make sealing contact with the surface of the particular rotary piston (7, 8), and a first exhaust aperture (26) being provided on the periphery of the working chamber, characterized in that additional exhaust apertures (27) are provided in the working chamber, closable by means of exhaust valves (15), which exhaust valves (15) are closable and openable successively by an adjusting means (17), the exhaust valves (15) being in the form of rotary slides whose axes are substantially parallel to the axis of said working chamber (4) and said compression chamber (3).

2. Rotary piston internal combustion engine having a substantially circular cylindrical compression chamber (3) and a substantially circular cylindrical working chamber (4), rotary pistons (7, 8) being arranged in the compression chamber (3) and in the working chamber (4), slides (19) being provided in the compression chamber (3) and in the working chamber (4), arranged movable in radial direction to make sealing contact with the surface of the particular rotary piston (7, 8), and a first exhaust aperture (26) being provided on the periphery of the working chamber, characterized in that additional exhaust apertures (27) are provided in the working chamber, closable by means of exhaust valves (15), which exhaust valves (15) are closable and openable successively by an adjusting means (17), said adjusting means (17) being in the form of a rotary slide.

3. Rotary piston combustion engine according to claim 2, wherein said exhaust valves (15) are in the form of rotary slides whose axes are substantially parallel to the axis of said working chamber (4) and said compression chamber (3).

4. Rotary piston combustion engine according to claim 2, wherein said adjusting means (17), having the form of a rotary slide, is in communication with said exhaust valves (15) by way of engaging levers (15*a*).

5. Rotary piston combustion engine according to claim 2, wherein said adjusting means (17) is actuable by way of a Bowden cable (18).

6. Rotary piston combustion engine according to claim 2, wherein, on the outer periphery of said working chamber (4), an exhaust manifold passage (28) is provided, connecting said first exhaust aperture (26) with said additional exhaust apertures (27).

7. Rotary piston combustion engine according to claim 2, wherein in each instance said two slides (19) are slidably mounted in a slide housing (9, 10).

8. Rotary piston combustion engine according to claim 2, wherein said two slides (19) bear rollers (20) at the peak.

9. Rotary piston combustion engine according to claim 2, further including sealing members in the form of wear parts (21) and leaf springs.

10. Rotary piston combustion engine according to claim 2, wherein, between said compression chamber (3) and said working chamber (4), connecting control valves (24, 24') are arranged to be opened and closed by said rotary pistons (7, 8).

11. Rotary piston combustion engine according to claim 10, wherein said connecting control valves (24, 24') comprise engagers (24*a*) entering into an engager groove of the rotary pistons (7*d*, 8*d*).

* * * * *